US006608991B2

(12) United States Patent
Takada

(10) Patent No.: US 6,608,991 B2
(45) Date of Patent: Aug. 19, 2003

(54) IMAGE FORMING APPARATUS WITH SPECIALIZED SHEET CONVEYANCE SPEED CONTROL

(75) Inventor: Hideaki Takada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/930,182

(22) Filed: Aug. 16, 2001

(65) Prior Publication Data

US 2002/0025206 A1 Feb. 28, 2002

(30) Foreign Application Priority Data

Aug. 22, 2000 (JP) ..... 2000-251389

(51) Int. Cl.[7] ..... G03G 15/00; G03G 15/01

(52) U.S. Cl. ..... 399/394; 399/45; 399/303; 399/396

(58) Field of Search ..... 399/394, 395, 399/396, 301, 303, 45

(56) References Cited

U.S. PATENT DOCUMENTS 4,451,027 A * 5/1984 Alper ..... 271/10.02
4,597,660 A * 7/1986 Leng et al. ..... 399/396
5,057,874 A * 10/1991 Miyazaki et al. ..... 399/396
5,119,146 A * 6/1992 Nobumori et al. ..... 399/396
5,870,114 A 2/1999 Numata et al. ..... 347/16
5,966,158 A 10/1999 Ebata et al. ..... 347/104
6,208,831 B1 * 3/2001 Amano ..... 399/396
6,259,886 B1 * 7/2001 Ishii et al. ..... 399/397 X
6,311,039 B1 * 10/2001 Funamizu et al. ..... 399/394
6,374,076 B1 * 4/2002 Tanaka ..... 399/396
6,397,035 B2 * 5/2002 Kataoka et al. ..... 399/396 X

* cited by examiner

*Primary Examiner*—Fred L. Braun
(74) *Attorney, Agent, or Firm*—Fitzpatrick, Cella, Harper & Scinto

(57) ABSTRACT

An image forming apparatus has a sheet material conveying system for conveying the sheet material to an image forming device and has an image formation driving source for driving the image forming device. A control is provided to vary the speed at which the sheet material is conveyed by the image forming device according to the kind of sheet material used, to control the conveyance driving source and the image formation driving source such that the speed at which the sheet material is conveyed by the sheet material conveying system when an image is formed by the image forming device is substantially the same as the speed at which the sheet material is conveyed by the image forming device, and to control the conveyance system driving source and the image formation driving source such that the speed at which the sheet material is conveyed by the sheet material conveying system before image forming device starts to form an image is substantially the same as or faster than the speed at which sheet material is conveyed by the image forming device.

17 Claims, 7 Drawing Sheets

IMAGE FORMING APPARATUS WITH SPECIALIZED SHEET CONVEYANCE SPEED CONTROL

BACKGROUND OF THE INVENTION

1. Field of the Invention

The present invention relates to an image forming apparatus having the function of forming an image on a recording material like a sheet, such as a copying machine, a printer, or a facsimile apparatus.

2. Description of the Related Art

Conventionally, an image forming apparatus of this type is equipped, for example, with a cassette provided in the apparatus main body and serving as a sheet loading means, and a manual feed tray provided, for example, on a main-body side surface and serving as a means for loading special paper sheets like cardboard sheets; sheets are conveyed to a registration roller pair by a sheet feeding means provided in each of the cassette and the manual feed tray, and are conveyed from the registration roller pair to an image forming portion with a controlled timing to thereby effect image formation.

The image forming portion, the conveying portion extending from the cassette to the registration roller pair, and the registration roller pair are driven by a single driving motor, and ON/OFF driving control is performed as needed by using an electromagnetic clutch or the like.

The sheet material fed from the cassette is conveyed to the registration roller pair by a conveying roller and its forward end abuts the registration roller pair to temporarily stop there. Then, the electromagnetic clutch for ON/OFF-controlling the driving of the registration roller pair in conformity with image formation timing is turned ON to drive the registration roller pair, and the sheet material is conveyed toward the image forming portion.

In the image forming portion, the sheet material is sequentially conveyed through the transfer portions of a plurality of photosensitive drums arranged in parallel, whereby developed toners on the photosensitive drums are sequentially transferred to the sheet material, thereby forming a color image on the sheet material. After the completion of the transfer, the transferred image is fixed to the sheet material by a fixing device arranged on the downstream side, whereby a sheet material with an image recorded thereon is obtained.

In the case of a special kind of sheet, such as a cardboard sheet or OHP sheet, the requisite quantity of heat for the fixing is relatively large. In view of this, the conveying speed of the fixing device is lowered to increase the requisite time for the sheet material to pass, whereby the quantity of heat imparted to the sheet is increased, thereby performing fixing in a stable manner.

However, the related art described above involves the following problems.

When an apparatus as described above is reduced in size, the distance between the fixing device and the transfer portion, which constitutes the image forming portion, is reduced, so that it is necessary to make the sheet material conveying speed in the fixing portion substantially equal to the sheet material conveying speed in the transfer portion. Further, it is also necessary to set the conveying speed in the transfer portion to be substantially equal to that in the registration roller pair.

Thus, it is necessary to perform conveyance at a substantially fixed conveying speed in the section from the sheet feeder to the registration roller pair and further, until the sheet has passed through the fixing device.

As a result, the conveying speed in the fixing portion becomes rather low, and more time is required for the output of a first sheet, resulting in a rather poor productivity.

As compared with monochrome printing, only using a toner of one color, this tendency is more conspicuous in the case of full color printing, in which images are recorded by using toners of four colors, since the amount of toner placed on the sheet is then so much the larger.

Further, since the registration roller pair and the image forming portion are driven by the same motor, it can happen that the shock when the sheet bumps into the registration roller pair or when it leaves the registration roller pair is transmitted to the image forming portion being driven, resulting in disturbance in the image.

SUMMARY OF THE INVENTION

The present invention has been made with a view toward solving the above problems in the related art. It is accordingly an object of the present invention to provide an image forming apparatus which helps to realize a reduction in apparatus size and an improvement in productivity and makes it possible to obtain a satisfactory image.

In a first aspect of the present invention, there is provided an image forming apparatus comprising: an image forming means including an image bearing member for bearing a toner image, and a sheet material supporting member for supporting a sheet material to which the toner image is transferred, and adapted to hold and convey the sheet material between the image bearing member and the sheet material supporting member to thereby transfer the toner image on the image bearing member to the sheet material; a sheet material conveying means for conveying the sheet material toward the image forming means; a registration means for correcting skew of the sheet material conveyed by the sheet material conveying means and conveying the sheet material to the image forming means with a predetermined timing; an image formation driving source for driving the image forming means; a conveyance system driving source for driving the sheet material conveying means and the registration means; and a control means which makes the speed at which the sheet material is conveyed by the sheet material conveying means variable and which controls the conveyance system driving source and the image formation driving source such that the speed at which the sheet material is conveyed by the registration means is substantially the same as the speed at which the sheet material is conveyed by the image forming means.

In accordance with the present invention, it is possible to independently set the speed at which conveyance is effected by the image forming means and the speed at which conveyance to the registration means is effected, so that it is possible to convey the sheet material at a speed which does not depend on the speed at which image formation is effected, and the interval of the sheet materials to be conveyed is reduced, whereby it is possible to achieve an improvement in terms of productivity. That is, it is possible to provide a high-quality image forming apparatus which is of a simple construction and reduced in size and which helps to realize an improvement in productivity.

Further, the impact generated when the sheet material enters the registration means and when it leaves the registration means is not transmitted to the image formation driving source, so that no disturbance is generated in the image, making it possible to obtain a satisfactory image.

In a second aspect of the invention, it is desirable that the control means control the conveyance system driving source such that the sheet material is conveyed to the image forming means by the registration means at a speed different from the speed at which the sheet material is conveyed to the registration means by the sheet material conveying means.

In a third aspect of the invention, it is desirable that the control means control the conveyance system driving source and the image formation driving source such that the sheet material is conveyed to the registration means by the sheet material conveying means at a speed higher than the speed at which the sheet material is conveyed by the image forming means.

In a fourth aspect of the invention, it is desirable that the control means control the conveyance system driving source such that after the forward end of the sheet material conveyed to the registration means abuts the registration means, the speed at which the sheet material is conveyed by the sheet material conveying means is changed from a first conveying speed to a second conveying speed which is lower than the first conveying speed, and that after the rear end of the sheet material has left the registration means, the speed at which the sheet material is conveyed by the sheet material conveying means is changed from the second conveying speed to the first conveying speed.

In a fifth aspect of the invention, the image forming apparatus further comprises a first drive transmitting means and a second drive transmitting means for transmitting a drive from the conveyance system driving source to the sheet material conveying means at different transmission ratios, and a transmission ratio switching means for switching drive transmission between the first drive transmitting means and the second drive transmitting means, and it is desirable that the control means control the transmission ratio switching means such that when the sheet material is conveyed to the registration means, the drive of the conveyance system driving source is transmitted to the sheet material conveying means through the first drive transmitting means, and that when the sheet material is conveyed to the image forming means by the registration means, the drive of the conveyance system driving source is transmitted to the sheet material conveying means through the second drive transmitting means.

In a sixth aspect of the invention, it is desirable that the transmission ratio switching means be an electromagnetic connecting means for electromagnetically connecting and cutting off the transmission of a rotation drive force, wherein the first drive transmitting means is a rotation drive transmitting member the transmission of which is connected by the electromagnetic connecting means, and wherein the second drive transmitting means is a rotation drive transmitting member which includes a one-way connecting means for exclusively transmitting rotation in one direction and whose reduction ratio is larger than that of the first drive transmitting means.

In a seventh aspect of the invention, it is desirable that the control means control the image formation driving source such that the sheet material is conveyed by the image forming means at two or more conveying speeds.

In an eighth aspect of the invention, the control means preferably has the function of varying the speed at which the sheet material is conveyed by the image forming means according to the kind of sheet material.

In a ninth aspect of the invention, the image formation driving source preferably includes different image formation driving sources respectively driving the image bearing member and the sheet material supporting member.

In a tenth aspect of the invention, the image forming means preferably includes a plurality of image bearing members, and a sheet material sequential conveyance means for sequentially conveying the sheet material to the plurality of transfer nip portions as the sheet material supporting member, wherein toner images respectively borne by the plurality of image bearing members are sequentially transferred to the sheet material conveyed by the sheet material sequential conveyance means.

In an eleventh aspect of the invention, the image formation driving source preferably includes different image formation driving sources for respectively driving the plurality of image bearing members and the sheet material sequential conveyance means.

In a twelfth aspect of the invention, the image forming apparatus preferably further comprises a fixing means which holds and conveys a sheet material to which an unfixed toner image has been transferred to thereby fix the toner image to the sheet material, wherein the fixing means is driven by the image formation driving source, and conveys the sheet material at a speed which is substantially the same as the speed at which the sheet material is conveyed by the image forming means.

In a thirteenth aspect of the invention, there is provided an image forming apparatus comprising: an image forming means for conveying a sheet material and forming an image on a sheet material; a conveying means for conveying the sheet material toward the image forming means; an image formation driving source for driving the image forming means; a conveyance system driving source for driving the conveying means; and a control means which makes the speed at which the sheet material is conveyed by the image forming means variable and controls the conveyance system driving source and the image formation driving source such that the speed at which the sheet material is conveyed by the conveying means is substantially the same as the speed at which the sheet material is conveyed by the image forming means when the image forming means forms an image.

In a fourteenth aspect of the invention, it is desirable that the control means controls the conveyance system driving source such that the sheet material is conveyed at a speed higher than the speed at which the sheet material is conveyed by the image forming means before the sheet material is conveyed by the image forming means.

In a fifteenth aspect of the invention, it is desirable that the control means has the function of varying the speed at which the sheet material is conveyed by the image forming means according to the kind of the sheet material.

In a sixteenth aspect of the invention, it is desirable that the image forming means includes: a plurality of image bearing members for bearing a different color toner image, and a conveying belt for conveying the sheet material, wherein the sheet material is conveyed between the image bearing members and the conveying belt by the conveying belt.

In a seventeenth aspect of the invention, it is desirable that the image forming means further includes a fixing means for fixing an unfixed image to the sheet material, and the image formation driving source for driving the image bearing members, the conveying belt, and the fixing means.

BRIEF DESCRIPTION OF THE DRAWINGS

In the accompanying drawings.

DESCRIPTION OF THE PREFERRED EMBODIMENTS

Preferred embodiments of this invention will now be described in detail with reference to the drawings.

Embodiment 1

An image forming apparatus according to Embodiment 1 will be described with reference to FIGS. 1 through 6.

Figure 1:
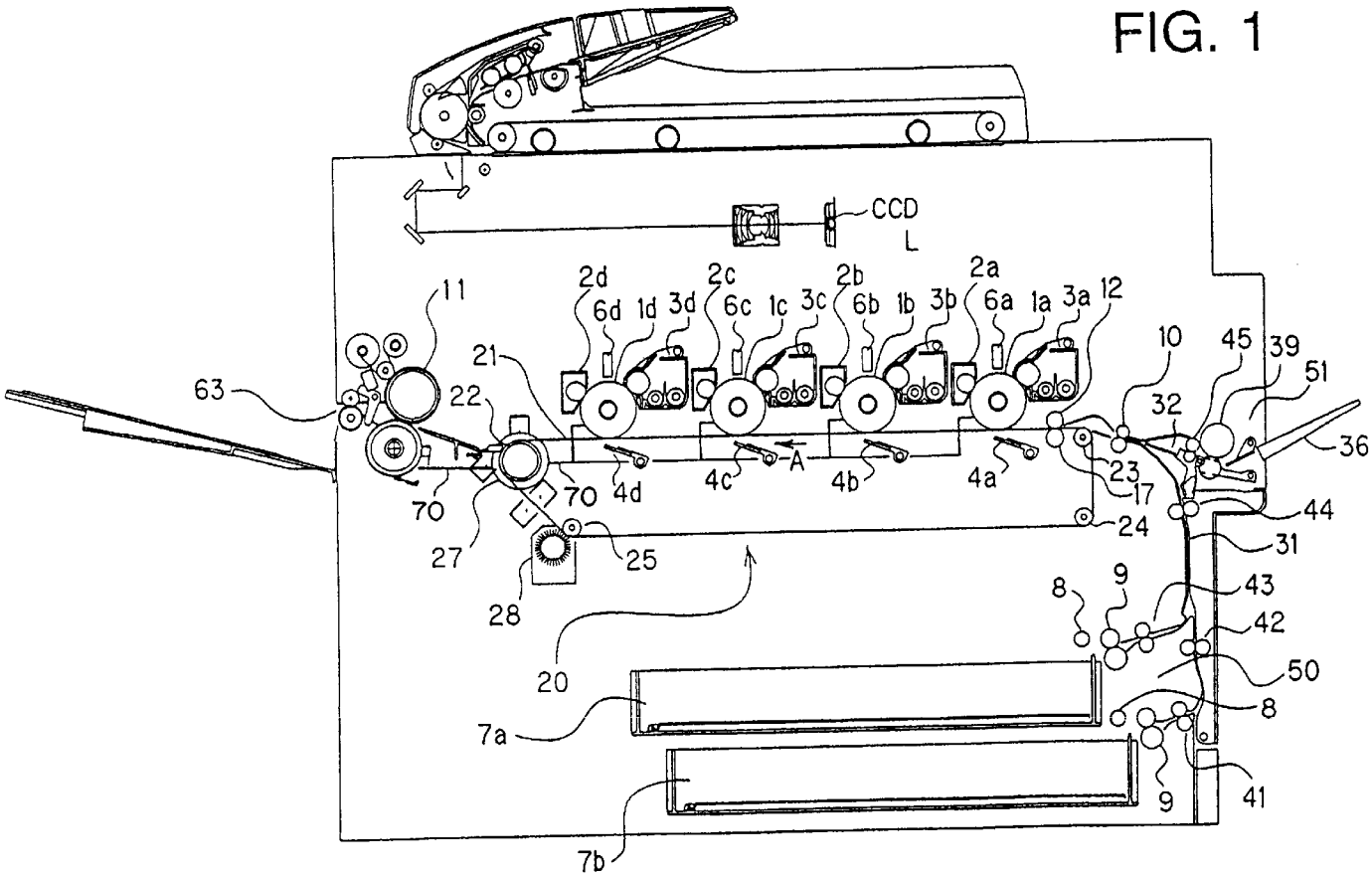
FIG. 1 is a schematic sectional view of a main portion of an image forming apparatus according to Embodiment 1.
Figure 2:
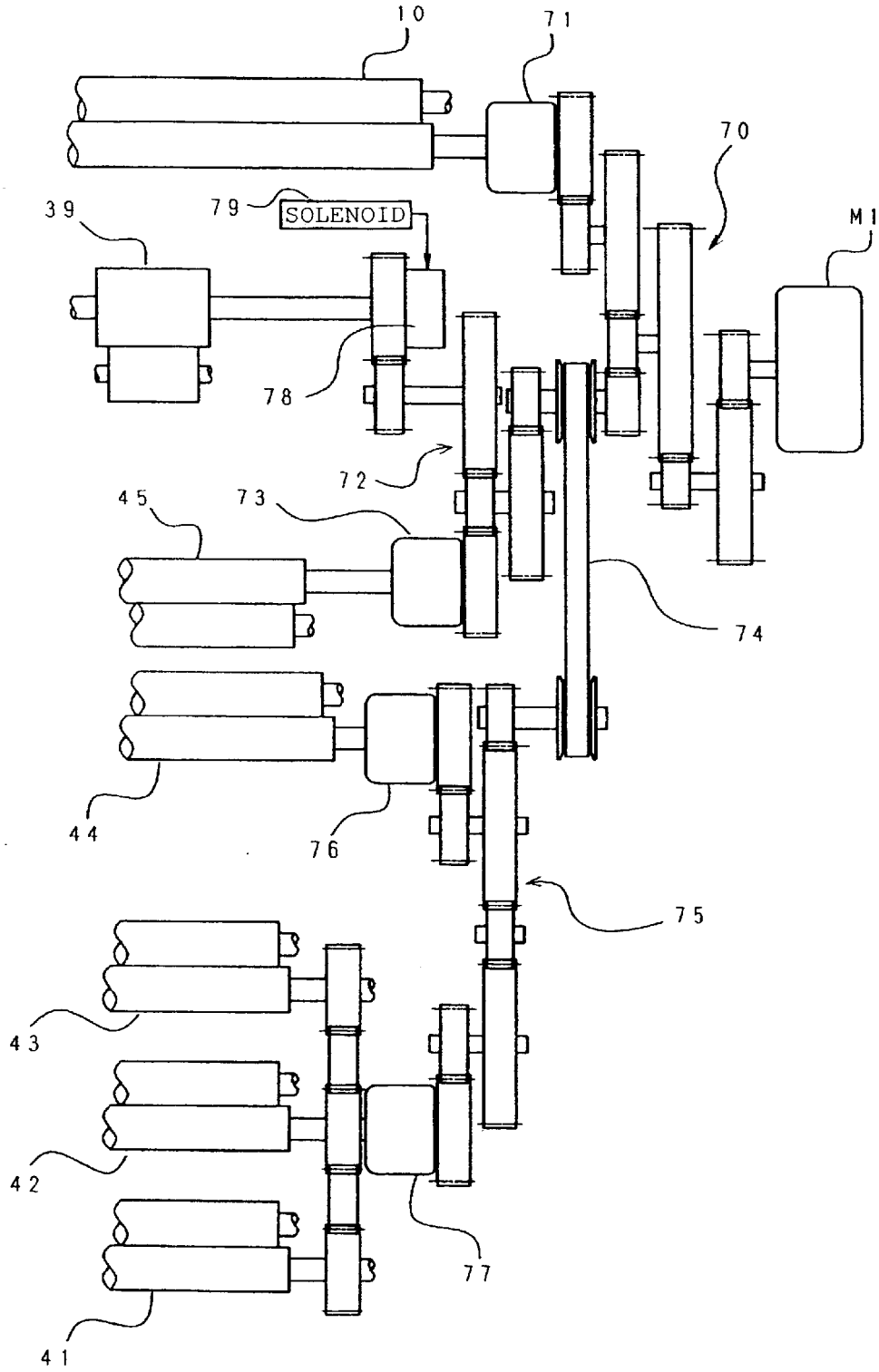
FIG. 2 is a developed view illustrating how the sheet material conveying system of an image forming apparatus according to Embodiment 1 is driven.
Figure 3:
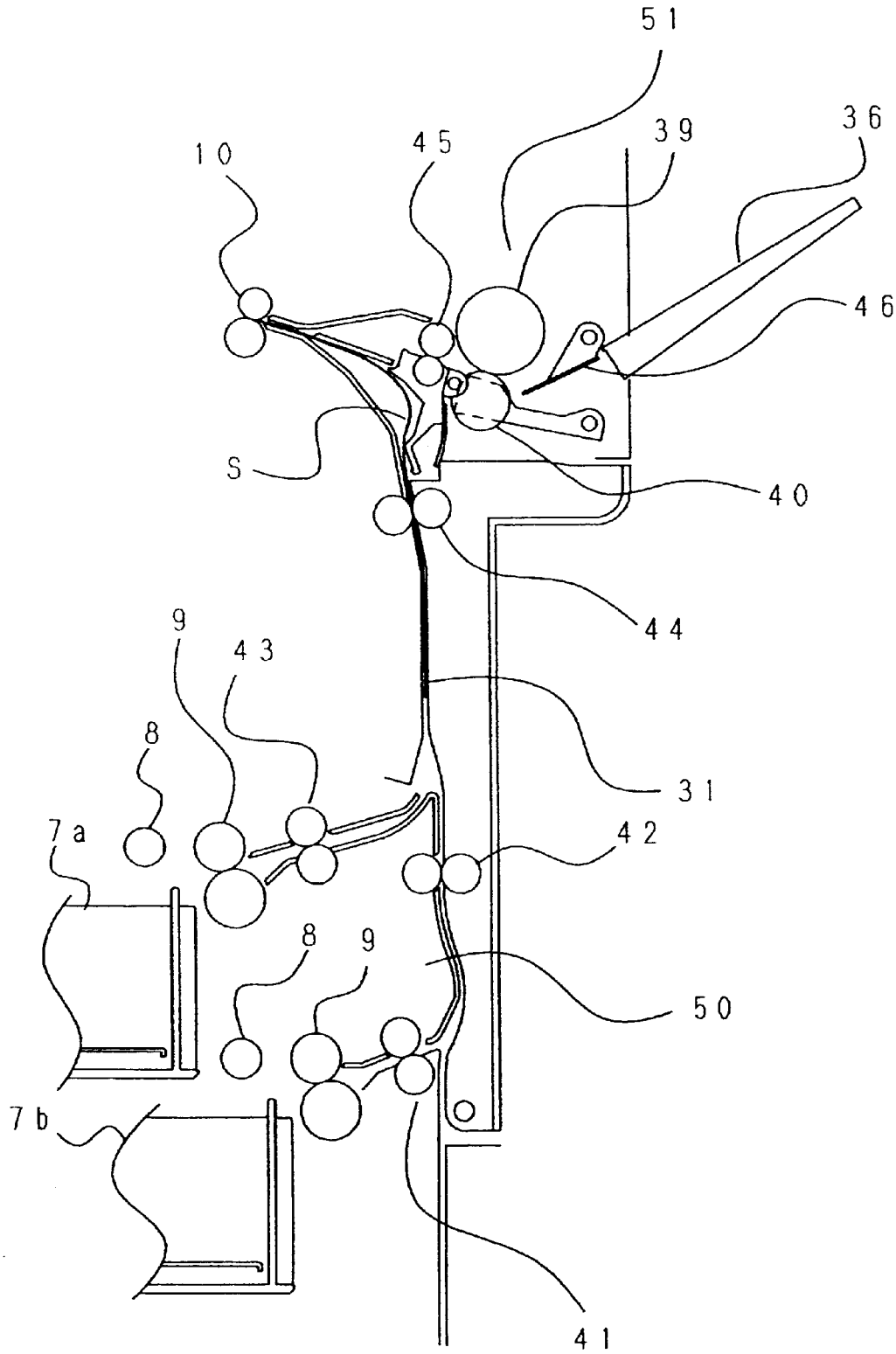
FIG. 3 is a schematic sectional view of a main portion of the sheet material conveying system of an image forming apparatus according to Embodiment 1.
Figure 4:
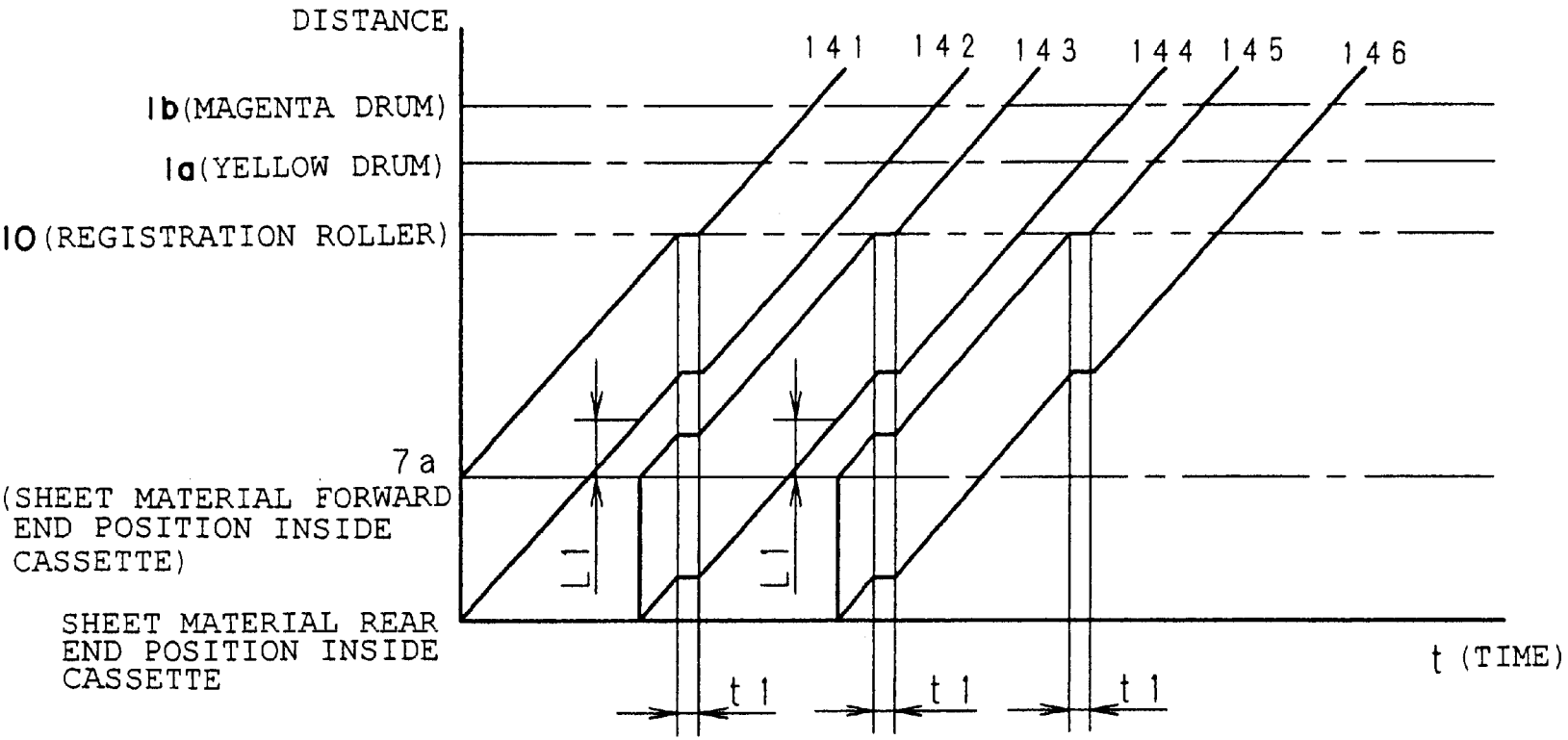
FIG. 4 is a diagram showing the relationship between time and position with respect to a sheet material according to Embodiment 1.
Figure 5:
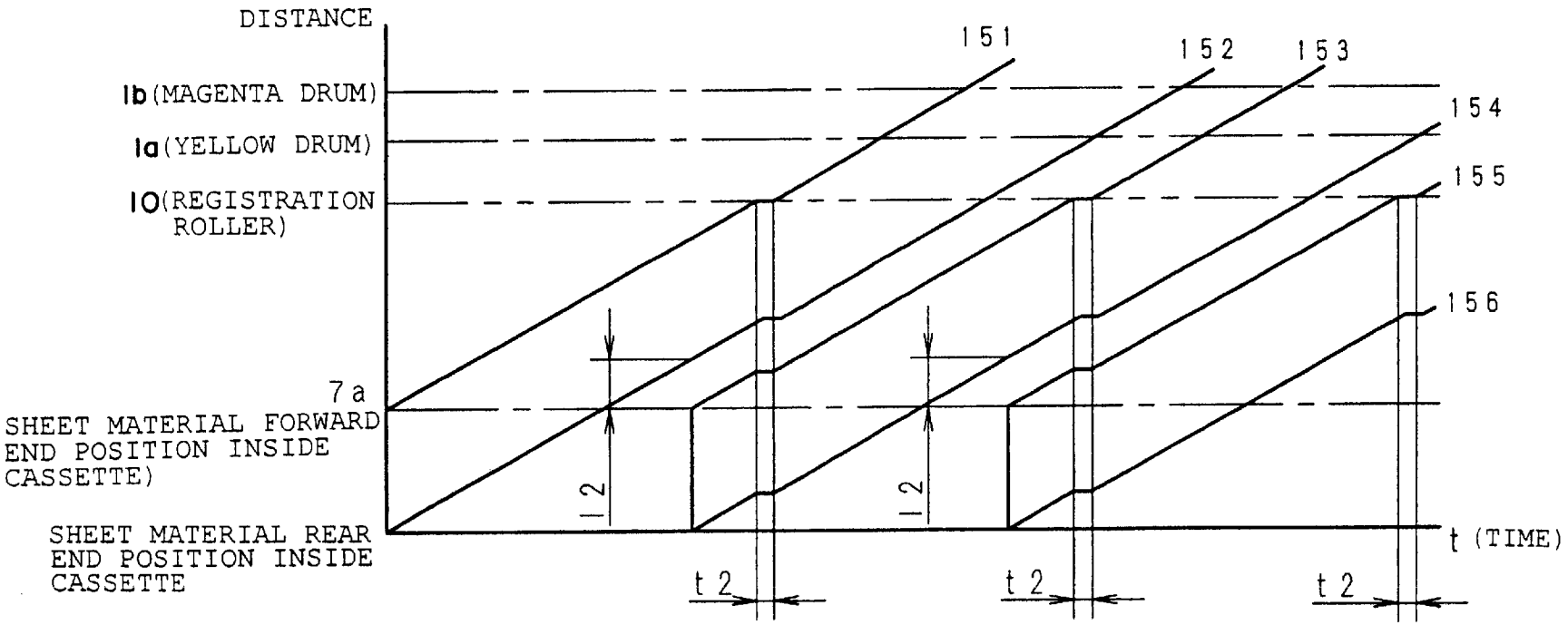
FIG. 5 is a diagram showing the relationship between time and position with respect to a sheet material according to Embodiment 1.
Figure 6:
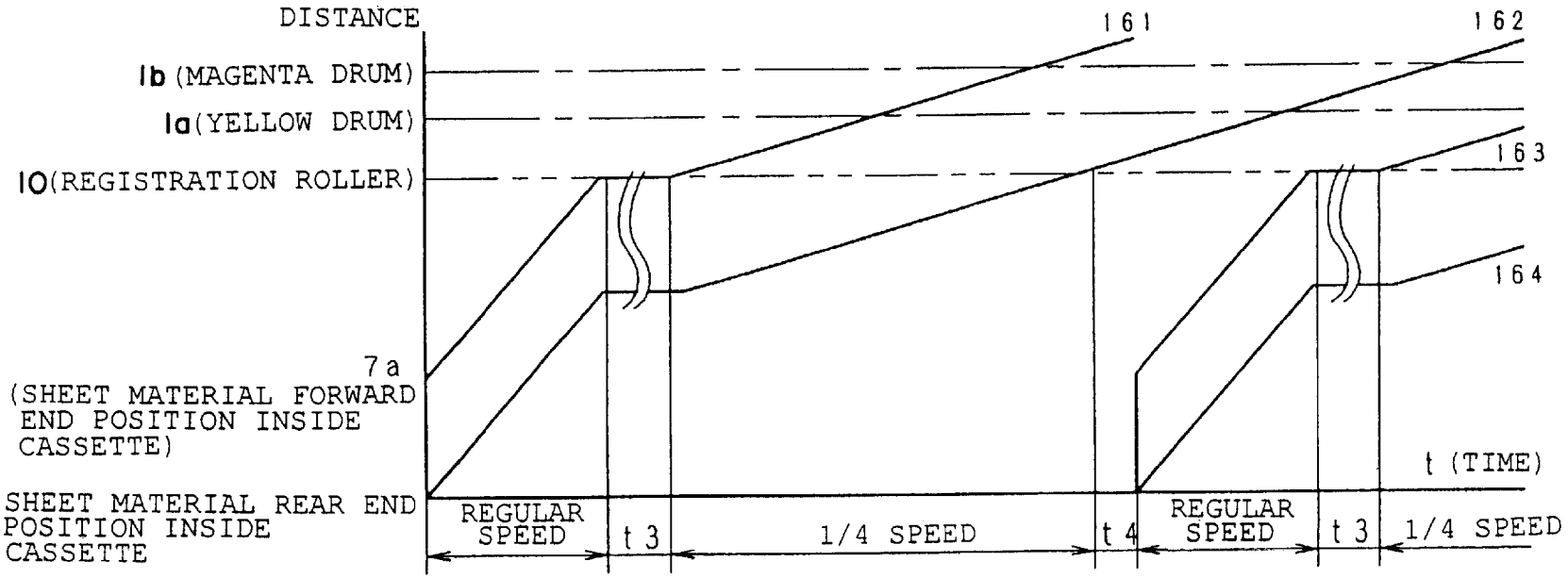
FIG. 6 is a diagram showing the relationship between time and position with respect to a sheet material according to Embodiment 1.

FIG. 1 is a schematic sectional view of a main portion of an image forming apparatus main body, FIG. 2 is a developed view illustrating the driving of a sheet material conveying system, FIG. 3 is a schematic sectional view of a main portion of the sheet material conveying system, and FIGS. 4, 5, and 6 are graphs showing the relationship between time and position in the conveyance of a sheet material.

First, an image forming apparatus to which the present invention is applied will be described with reference to FIG. 1. This apparatus adopts an image forming means comprising four photosensitive drums 1*a*, 1*b*, 1*c*, and id serving as image bearing members arranged in parallel and adapted to form toner images of magenta, cyan, yellow, and black, and a transfer belt 21 arranged so as to run through below these drums and serving as a sheet material supporting member and as a sheet material sequential conveying means.

Arranged around the photosensitive drums 1*a*, 1*b*, 1*c*, and 1*d* are primary chargers 2*a*, 2*b*, 2*c*, and 2*d*, developing units 3*a*, 3*b*, 3*c*, and 3*d*, and transfer chargers 4*a*, 4*b*, 4*c*, and 4*d*, and, arranged above the photosensitive drums 1*a* through 1*d* are exposure devices 6*a*, 6*b*, 6*c*, and 6*d* consisting of LEDs or the like.

The photosensitive drums 1*a*, 1*b*, 1*c*, and 1*d* are charged by the respective chargers 2*a*, 2*b*, 2*c*, and 2*d*, and the yellow, magenta, cyan, and black light images which have undergone color separation are exposed by the respective exposure devices 6*a*, 6*b*, 6*c*, and 6*d* to form yellow, magenta, cyan, and black latent images respectively on the photosensitive drums 1*a*, 1*b*, 1*c*, and 1*d*. The latent images are respectively developed by the developing units 3*a*, 3*b*, 3*c*, and 3*d* to sequentially form yellow, magenta, cyan, and black toner images on the photosensitive drums 1*a*, 1*b*, 1*c*, and 1*d*.

Sheet materials S constituting the recording materials are accommodated in cassettes 7*a* and 7*b*.

The cassettes 7*a* and 7*b* can be drawn out toward the front. For example, the supply of sheet materials, the clearing of a paper jam in the cassette, etc. can be effected by drawing out the cassette toward the front in FIG. 1.

Further, sheet materials S can also be placed on a manual feed tray 36.

The sheet materials S are sent out one by one from the cassette 7*a* or 7*b* by a pick-up roller 8, and are guided and conveyed through a conveyance path 31 to a registration roller pair 10 serving as the registration means by conveying roller pairs 41, 42, and 43, and a pre-registration roller pair 44 serving as the sheet material conveying means which conveys the sheet materials S to the registration roller pair 10. At the registration roller pair 10, skew of the sheet is corrected, and the sheet is adjusted in timing before it is placed on the transfer belt 21 and electrostatically attracted thereto, and is conveyed in the direction of the arrow A. The sheet material S on the manual feed tray 36 is guided to a conveyance path 32 by a manual feed paper feeding roller 39, and is conveyed to the registration roller pair 10 before it is placed on the transfer belt 21.

The sheet material S attracted by the transfer belt is sequentially conveyed to transfer (nip) portions respectively opposed to the photosensitive drums 1*a*, 1*b*, 1*c*, and 1*d* by the running of the transfer belt 21. The toner images of the different colors on the photosensitive drums 1*a*, 1*b*, 1*c*, and 1*d* are sequentially transferred to the sheet material S serving as the recording material by the action of the transfer blades of transfer chargers 4*a*, 4*b*, 4*c*, and 4*d* which are respectively arranged in the transfer portions and to which a voltage of a polarity reverse to that of the toners is applied, whereby a color image is obtained which consists of toner images of the four colors of yellow, magenta, cyan, and black superimposed one upon the other on the sheet material S.

The sheet material S to which the toner image of the four colors have been transferred is separated from the forward end of the transfer belt 21 with respect to the conveying direction, and is conveyed to the fixing device 11 serving as the fixing means. In the fixing nip portion, the toner images are fixed to the sheet material by heat and pressure, whereby the toners of the different colors are melted and mixed with each other to provide a full color print image fixed to the sheet material S. Thereafter, the sheet material is discharged to the exterior of the image forming apparatus by a discharge conveyance means 63 provided on the downstream side of the fixing device 11.

The respective rotation sleeves provided in the primary chargers 2*a*, 2*b*, 2*c*, and 2*d*, the respective rotation sleeves provided in the developing devices 3*a*, 3*b*, 3*c*, and 3*d*, the fixing device 11, the photosensitive drums 1*a*, 1*b*, 1*c*, and 1*d*, and the transfer belt 21, are respectively driven by an image formation driving motor 27 serving as the image formation driving source (not shown) which is the same driving source through a speed reduction driving system 70 indicated by the solid line in FIG. 1.

A belt conveyance portion 20 is formed by winding the transfer belt 21 for conveying the sheet material S around a transfer belt driving roller 22 driven by the image formation driving motor and a plurality of supporting rollers 23, 24, and 25.

A transfer belt cleaner 28 serves to remove toner adhering to the transfer belt 21, and is brought into contact with and separated from the transfer belt 21 as needed by a contact/separation mechanism (not shown); a cleaner brush rotates to scrape off the toner on the transfer belt 21.

FIG. 2 is a developed view of the driving of the registration roller pair 10, the manual feed paper feeding roller 39, the manual feed conveyance roller pair 45, the conveyance roller pairs 41, 42, and 43, and the pre-registration conveyance roller pair 44.

The output of the conveyance driving motor M1 serving as the conveyance system driving source undergoes speed reduction by a speed reduction gear row 70 composed of a plurality of gears, and a drive is transmitted to the registration roller pair 10 through a registration roller clutch 71. From the speed reduction gear row 70, the drive of the conveyance driving motor M1 is respectively transmitted to the manual feed paper feeding roller 39 through a manual feed paper feeding speed reduction gear row 72 and a missing-teeth gear 78, and to the manual feed conveyance roller pair 45 through a manual feed speed reduction gear row 72 and a manual feed conveyance clutch 73.

Further, a drive is transmitted from the speed reduction gear row 70 to the conveyance roller pairs 41, 42, and 43, and the pre-registration conveyance roller pair 44 by a timing belt 74. The driving force transmitted by the timing belt 74 undergoes speed reduction by a conveyance roller speed reduction gear row 75, and a drive is transmitted to the pre-registration roller pair 44 through a pre-registration roller clutch 76.

A drive is transmitted to the conveyance roller pairs 41, 42, and 43 from a conveyance roller speed reduction gear row 75 through a conveyance roller clutch 77.

The conveyance driving motor Ml consists of a DC brushless motor controlled by a PLL system, and its rotating speed can be switched between the three levels: regular speed, ½ speed, and ¼ speed.

Like the conveyance driving motor M1, the image formation driving motor 27 consists of a DC brushless motor controlled by a PLL system, and its rotating speed can be switched between the three levels: regular speed, ½ speed, and ¼ speed.

The conveyance of the sheet material will now be described in detail with reference to FIG. 3.

The sheet materials S loaded in the cassettes 7*a* and 7*b* which constitute the sheet material loading means of the cassette paper feeding mechanism 50 that is the first conveying means are fed by the pick-up rollers 8 driven by a stepping motor (not shown), and separated and conveyed by conveyance/separation roller pairs 9. The conveyance/separation roller pairs 9 are also driven by the stepping motor (not shown) driving the pick-up rollers 8, and the upper/lower switching in the driving of the pick-up rollers 8 and the conveyance/separation roller pairs 9, respectively provided for the upper cassette 7*a* and the lower cassette 7*b*, is effected by switching the rotating direction of the stepping motor to thereby cause a planetary gear or a gear providing a similar action to move to thereby switch the gear to be connected for driving.

Since the pick-up rollers are driven by using a stepping motor, it is possible to arbitrarily control the rotation of the pick-up rollers 8 and the conveyance/separation rollers 9 when picking up the sheet material, whereby it is possible to effect a pick-up with a slow start-up or the like, making it possible to perform paper feeding with high separation performance and high conveyance performance.

The sheet material S fed is conveyed through the conveyance path 31 by the conveyance roller pairs 41, 42, and 43 driven by the conveyance driving motor M1 through the speed reduction gear row 70, the timing belt 74, the conveyance roller speed reduction gear row 75, and the conveyance roller clutch 77.

The pre-registration roller pair 44 is also driven through the conveyance roller speed reduction gear row 75 and the pre-registration roller clutch 76 to convey the sheet material.

The forward end of the sheet material S is detected by a pre-registration sensor (not shown) provided immediately before the registration roller pair 10. When a predetermined period of time has elapsed after the forward end of the sheet has abutted the nip portion of the registration roller pair 10 which is at rest, with the registration roller clutch 71 being in the OFF state, the pre-registration conveyance roller clutch 76 is turned OFF to stop the pre-registration conveyance roller pair 44, whereby a loop is formed between the registration roller pair 10 and the pre-registration conveyance roller pair 44, and the forward end of the sheet material S is pressed against the nip portion of the registration roller pair 10 to attain the state as shown in FIG. 3.

In this state, the rotating speed of the conveyance driving motor M1 is varied by a control means as needed such that the conveying speed in the image forming portion where image formation is performed by the image forming means is the same as the conveying speed at which conveyance is effected by the registration roller pair 10. When a fixed level has been achieved, the registration roller clutch 71 is turned ON to start the driving of the registration roller pair 10, conveying the sheet to the image forming portion.

The conveying speed at which the sheet material is conveyed by the registration roller pair 10 is set to be higher than the sheet material conveying speed in the image forming portion by approximately 0 to 1.5%, and a loop is gradually formed as the sheet material S is conveyed between the registration roller pair 10 and the transfer belt 21. Due to this arrangement, the sheet material is prevented from being pulled between the registration roller pair 10 and the transfer belt 21. Further, when the rear end of the sheet material S leaves the registration roller pair 10, it is possible to convey the sheet material without allowing the shock involved to be transmitted to the sheet material placed on the transfer belt 21.

In the case of an ordinary paper sheet, the conveying speed in the image forming portion is the regular one. In this case, the conveyance driving motor M1 rotates at regular speed from the first, conveying the sheet material S at regular speed. And, the driving of the registration roller pair 10 is started without effecting speed switching on the conveyance driving motor M1, which is effected in the state in which the sheet material S forms a loop between the registration roller pair 10 and the pre-registration conveyance roller pair 44.

When performing continuous recording, the preceding sheet material is fed, and the next sheet material is fed at a predetermined inter-sheet distance. When the pre-registration conveyance roller pair 44 is at rest, with the sheet forming a loop before the registration roller pair 10, the sheet material on the upstream side is also on standby at a predetermined inter-sheet distance by causing the conveyance roller pairs 41, 42, and 43 to stop. When the registration roller clutch is turned ON to start conveyance, the conveyance roller clutch 77 and the pre-registration conveyance roller clutch 76 are simultaneously turned ON to drive the conveyance roller pairs 41, 42, and 43 and the pre-registration roller pair 44, continuing conveyance while keeping a fixed inter-sheet distance.

When the conveyance speed in the image forming portion is different from the speed at which the sheet material is conveyed to the registration roller pair 10, paper feeding is effected at the speed at which the sheet material is conveyed from each cassette 7*a*, 7*b* to the registration roller pair 10, and the sheet material is conveyed at the same speed by the conveyance roller pairs 41, 42, and 43 and the pre-registration conveyance roller pair 44, the forward end of the sheet material being conveyed to the nip portion of the registration roller pair 10.

When a predetermined loop has been formed, the pre-registration conveyance clutch 76 is turned OFF to stop the driving of the pre-registration conveyance roller pair 44, and in this state, the rotating speed of the conveyance driving motor M1 is changed so as to achieve a predetermined conveying speed which is higher than the conveying speed in the image forming portion by approximately 0 to 1.5%. When the speed change has been completed and the rotation has become stabilized, the registration roller clutch 71 and the pre-registration conveyance roller clutch 76 are turned ON to convey the sheet material S to the image forming portion.

The speed at which the sheet material is conveyed to the registration roller pair 10 and the conveying speed in the image forming portion are respectively determined taking into account the material, conveyance performance, and productivity of the sheet material.

In this embodiment, in the case of an ordinary paper sheet, both the speed at which the sheet is conveyed to the registration roller pair 10 and the conveying speed in the image forming portion are regular speed. In the case of a cardboard sheet, recording operation is performed by setting both the speed at which the sheet is conveyed to the registration roller pair 10 and the conveying speed in the image forming portion to ½ conveying speed. In the case of an OHP sheet, the sheet is conveyed to the registration roller pair 10 at regular conveying speed, and is conveyed in the image forming portion at ¼ conveying speed to perform recording operation thereon.

The sheet conveyance control for the different sheet materials will be respectively described with reference to FIGS. 4, 5, and 6.

In FIGS. 4 through 6, the horizontal axis indicates time, and the vertical axis indicates conveying distance in the sheet path. In the diagrams, the origin indicates the position of the forward end of the sheet material in the cassette at the sheet feeding start. The position of the registration roller pair 10 and the positions of the photosensitive drums 1*a* and 1*b* constituting the image forming portion positioned on the downstream side thereof are given in the diagrams. The photosensitive drum 1*c* and the portions on the downstream side thereof are omitted in the diagrams.

In FIGS. 4 through 6, each of the solid lines 141, 151, and 161 indicates the position of the forward end of a first sheet material. Each of the solid lines 142, 152, and 162 indicates the position of the rear end of the first sheet material. Similarly, each of the solid lines 143, 153, and 163 indicates the forward end of a second sheet material, and each of the solid lines 144, 154, and 164 indicates the rear end of the second sheet material. In this way, each of the solid lines with an odd number indicates the forward end position of a sheet material, and each of the solid lines with an even number indicates the rear end position of a sheet material.

As shown in FIG. 4, in the case of recording on an ordinary paper sheet, the sheet material is fed and conveyed at regular speed. As indicated by the solid line 141, the forward end of the sheet material abuts the registration roller pair 10 and stays at rest for a period of time t1, forming a loop during that time between it and the pre-registration conveyance roller pair. After the period of time t1 has elapsed, the registration roller pair and the rollers on the upstream side thereof are driven at regular speed to convey the sheet material to the image forming portion.

The conveyance of the second sheet material onward is conducted as follows. As indicated by the solid line 143, when the distance between the succeeding sheet material and the rear end 142 of the preceding sheet material has become a predetermined sheet distance L1, the feeding and conveyance is started. When the preceding sheet material is at rest in the registration roller portion, the succeeding sheet material also stops to maintain the sheet material distance, and the conveyance is started simultaneously with the driving of the registration roller pair 10. When sheet material recording is to be continuously conducted, similar operations are conducted.

When performing recording on cardboard sheets, control is performed as shown in FIG. 5.

In the case of cardboard sheets, the feeding and conveyance speed and the speed in the image forming portion are all ½ speed, so that, as compared with the case of the ordinary paper conveyance control as described above, doubling occurs in the direction of the horizontal axis, which constitutes the time axis for ordinary paper conveyance control.

The forward end of the first sheet material (indicated by the solid line 151) abuts the registration roller pair 10 at ½ feeding and conveyance speed, and after a predetermined period of time t2 has elapsed since then, the registration roller pair 10 and the pre-registration conveyance roller pair are driven at ½ speed, the sheet being conveyed to the image forming portion where recording is effected at ½ speed.

The reason for performing the above-described control in the case of recording on cardboard sheets is as follows. The fixing cannot be effected to a sufficient degree by the fixing device 11 constituting the fixing portion unless the conveyance is effected at a conveyance speed which is ½ of the regular speed. Further, no problem due to the ½ speed is generated in the feeding and conveyance, and it has been determined that there is no need to go so far as to effect speed changing on the conveyance driving motor M1 when a loop is being formed on the upstream side of the registration roller pair 10 to perform conveyance to the registration roller pair 10 at regular speed.

In the case of recording on OHP sheets, control is performed as shown in FIG. 6.

The first sheet material is conveyed as follows. First, until the forward end of the sheet material (indicated by the solid line 161) reaches the registration roller pair 10 and a loop is formed between it and the pre-registration conveyance roller pair, the conveyance is executed at regular speed, which is the first conveyance speed. Thereafter, during the period of time t3, the speed of the conveyance driving motor M1 is changed from regular speed to ¼ speed to drive the registration roller pair 10 and the pre-registration conveyance roller pair, and the sheet is conveyed at ¼ speed, which is the second conveying speed, to the image forming portion where image recording is effected at ¼ speed.

The feeding and conveyance of the second sheet onward is performed as follows. During the period of time t4 after the rear end of the preceding sheet material (indicated by the solid line 162) has left the registration roller pair 10, the speed of the conveyance driving motor M1 is changed from ¼ speed to regular speed, and then feeding and conveyance is performed at regular speed.

In the case of recording on OHP sheets, a conveying speed of ¼ speed is required in the fixing device 11 constituting the fixing portion, so that the conveying speed in the image forming portion is set to ¼ speed. Regarding the speed at which the sheet is conveyed to the registration roller pair 10, it is set to regular speed because at ¼ speed it is impossible to perform feeding operation in a stable manner (Slippage is likely to occur) and because when the sheet is conveyed at ¼ speed to the registration roller pair 10, the requisite conveyance time for the first OHP sheet is four times than when it is conveyed at regular speed, resulting in a substantial increase in the first copying (printing) time and an extremely low productivity. When forming a loop, the rotating speed of the conveyance driving motor M1 is switched so that the OHP sheet may be output from the registration roller pair 10 at ¼ conveying speed (This setting involves less first copying (printing) time even with the requisite time for the switching included).

In this case, when performing continuous recording, the first OHP sheet is discharged from the registration roller pair 10, and the conveyance driving motor M1 is switched to the regular rotating speed before feeding and conveying the second sheet, which is conveyed to the registration roller pair 10; after the formation of the loop, the conveying speed by the conveyance driving motor M1 is switched. In this way, the above operation is repeated, resulting in a rather low productivity for continuous recording. However, taking into account the nature of OHP sheets, it is to be assumed that it is rare for recording to be performed on a plurality of OHP sheets from the same original. Thus, the low productivity in continuous recording does not much matter. Thus, first priority is given to the first copying time and the conveying performance.

When paper sheets are fed from the manual feed portion 51, which constitutes the second conveying means, the drive of the conveyance driving motor M1 is subjected to speed reduction by the speed reduction gear row 70, and transmitted to the paper feeding roller 39 and the manual feed conveyance roller pair 45. By controlling the missing-teeth gear 78, which partly lacks teeth to thereby allow intermittent control, by a solenoid 79, the paper feeding roller 39 is controlled to substantially make one rotation.

In the paper feeding operation, an intermediate plate 46 is first biased toward the manual feed paper feeding roller 39 by a pressurization control means (not shown), and the forward end of the sheet materials loaded on the manual feed tray 36 is brought into press contact with the manual feed paper feeding roller 39.

In this state, when the solenoid 79 is attracted, the missing-teeth gear 78 is connected with an input gear to substantially make one rotation, and stops when a stopper portion (not shown) abuts the solenoid 79. By this operation, the paper feeding roller 39 substantially makes one rotation, conveying the sheet material to the manual feed conveyance roller pair 45. At this time, a separation roller 40 rotates with a predetermined torque so as to return the sheet material, thereby preventing double feeding and intrusion of the second sheet material onward.

The drive of the conveyance driving motor M1 is transmitted to the manual feed conveyance roller pair 45 by the manual feed conveyance clutch 73, and, as in the case of the control of the pre-registration conveyance roller pair 44, the forward end of the sheet material is detected by a pre-registration sensor (not shown) before the forward end of the sheet material abuts the nip portion of the registration roller pair 10 to stop after forming a predetermined loop. Then, the forward end of the sheet material is pressed against the nip portion of the registration roller pair 10. From this onward, an operation similar to the paper feeding from the cassette is conducted.

The relationship between the conveying speed in the image forming portion and the speed at which the sheet is conveyed to the registration roller pair 10 is determined in the same way as in the case of the cassette paper feeding described above.

Regardless of whether cassette paper feeding or manual paper feeding is to be performed, the driving of the registration roller pair 10 and the conveying roller on the upstream side thereof is effected by the conveyance driving motor M1, which is separate from the image formation driving motor 27 for image formation, whereby the impact when the sheet material enters and leaves the roller nip portion is not transmitted to the image formation driving motor 27. Thus, no disturbance is generated in the image, making it possible to obtain a satisfactory image.

Further, even when the transfer and fixing have not been completed yet, it is possible to switch the conveying speed when the sheet material has been conveyed from the registration roller pair, so that even in the case of the apparatus of this embodiment, which has a plurality of transfer means and in which the conveying distance of the image forming portion is long, it is possible to perform paper feeding and conveyance at a speed independent of the image forming speed, and reduce the inter-sheet distance, thereby achieving an improvement in terms of productivity.

Further, since it is possible to independently set the conveying speed in the image forming portion and the speed at which the sheet material is conveyed to the registration roller pair 10, it is possible to provide an image forming apparatus excelling in both productivity and sheet material conveying performance.

While in this embodiment an image formation driving motor is used as the image formation driving source for driving the image forming means, it is also possible to respectively drive the photosensitive drums and the transfer belt by independent motors in order to accurately perform color registration of the toners, which is required when forming a color image. In particular, by performing direct driving without any speed reduction by using an ultrasonic motor, it is possible to perform accurate color registration, thereby effecting a recording with high image quality.

Embodiment 2

Figure 7:
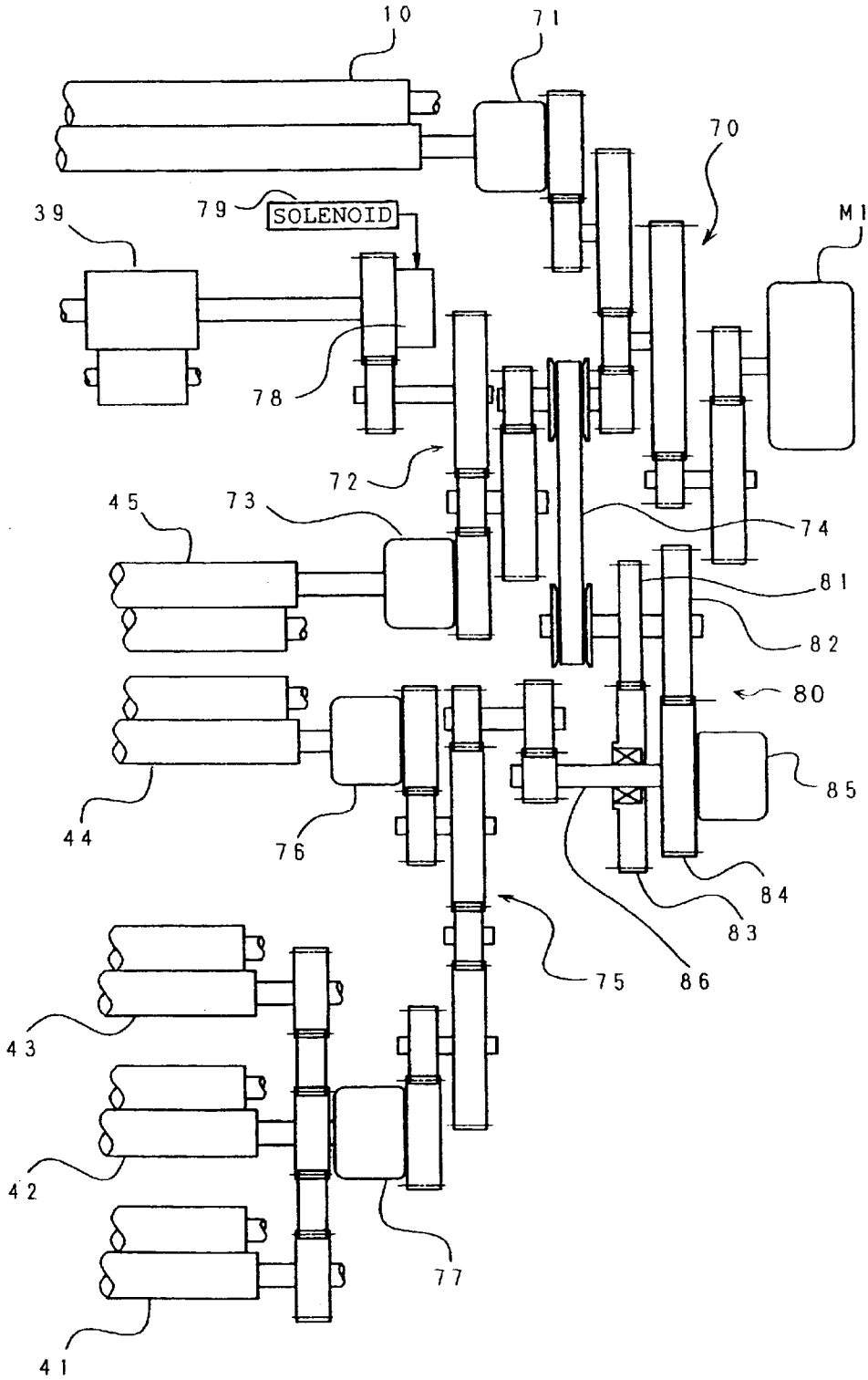
FIG. 7 is a developed view illustrating how the sheet material conveying system of an image forming apparatus according to Embodiment 2 is driven.

Embodiment 2 will be described with reference to FIG. 7. FIG. 7 is a developed view showing the driving of the sheet material conveyance system in this embodiment.

In this embodiment, the driving speed reduction system serving as the drive transmission rotating member of the conveying roller of the longitudinal path guide portion and the pre-registration conveying roller is provided with a speed-up switching mechanism using a clutch serving as an electromagnetic connecting means for switching speed and a one-way clutch serving as a one-way connecting means. The components which are the same as those of Embodiment 1 are indicated by the same reference numerals, and a description of such components will be omitted.

The operation of feeding and conveying paper sheets from the cassettes 7*a* and 7*b* to the registration roller pair 10 in this embodiment will be described below.

The sheet materials fed from the cassettes 7*a* and 7*b* serving as the sheet material loading means of the cassette paper feeding mechanism 50 constituting the first conveying means are conveyed through the conveyance path 31 by the conveyance roller pairs 41, 42, and 43 driven by the conveyance driving motor M1 through the speed reduction gear row 70, the timing belt 74, a gear row 80 serving as the speed-up switching mechanism, the conveying roller speed reduction gear row 75, and the conveying roller clutch 77.

In the speed-up switching mechanism formed by the gear row 80, input gears 81 and 82 having different numbers of teeth are respectively engaged with a gear 83 which is a rotation drive transmitting member serving as a first drive transmitting means with a built-in one-way clutch serving as a one-way connecting means, and a gear 84 which is a rotation drive transmitting member serving as a second drive transmitting means that allows the ON/OFF control of drive transmission by a speed-up electromagnetic clutch 85 serving as a speed transmission ratio switching means and an electromagnetic connecting means, transmitting a drive to a transmission shaft 86. The one-way clutch is connected such that when the gear 83 rotates in the normal direction, a drive is transmitted to the transmission shaft 86, and that when the transmission shaft 86 rotates in the normal direction with respect to the gear 83, no drive is transmitted from the transmission shaft 86 to the gear 83.

The speed reduction ratio between the input gear 81 and the gear 83 with a built-in one-way clutch is set to be larger than the speed reduction ratio between the input gear 82 and the gear 84 that can be controlled by the electromagnetic clutch 85. When the electromagnetic clutch 85 is OFF, the drive due to the engagement between the input gear 82 and the gear 84 is not transmitted to the transmission shaft 86, and a drive is transmitted from the input gear 81 to the gear 83 with a built-in one-way clutch.

When the electromagnetic clutch 85 is ON, the drive input from the input gear 82 to the gear 84 is transmitted to the transmission shaft 86 to effect driving. At this time, rotation is also transmitted from the input gear 81 to the gear 83 with a built-in one-way clutch. However, since its speed reduction ratio is set to be larger than that of the gear 84 that is controlled by an electromagnetic clutch, the rotating speed of the gear 83 is lower than that of the transmission shaft 86. Thus, no drive is transmitted by the action of the one-way clutch. As a result, the speed reduction ratio transmitted to the transmission shaft 86 is determined by the speed reduction ratio between the gear 84 controlled by an electromagnetic clutch and the second input gear 82.

In this construction, when ordinary paper sheets are fed from the cassettes 7*a* and 7*b* and image formation is performed at regular speed, the speed-up electromagnetic clutch 85 is turned ON for the recording on the first sheet to reduce the speed reduction ratio in the speed-up switching mechanism 80, whereby the speed at which the sheet is conveyed by the conveyance roller pairs 41, 42, and 43, and the pre-registration roller pair 44 is increased, and the requisite time for the forward end of the first sheet material to reach the registration roller pair 10 is reduced, the speed-up electromagnetic clutch 85 being turned OFF after the loop formation to adjust the conveying speed to the image formation conveying speed.

In the case of the switching of rotation by the conveyance driving motor M1, it usually takes approximately 0.5 to 1.5 seconds for the switching to be completed to attain a stable rotating speed, whereas, in this case, it is only the requisite time for turning OFF the electromagnetic clutch that is required, so that the requisite switching time is as short as approximately 30 msec to 50 msec.

Due to this arrangement, it is possible to substantially reduce the requisite time for the first sheet to be discharged from the apparatus after the completion of the recording (first copying (printing) time), thereby achieving an improvement in terms of productivity. It is to be noted, in particular, that the longer the conveying path to the registration roller pair 10, the higher the productivity improving effect.

When performing recording continuously, subsequent to the feeding and conveyance of the first sheet material, the feeding and conveyance of the second sheet material onward is effected with a timing such that the inter-sheet distance is the same as that in the case of the normal conveying speed. The forward end of the first sheet material is conveyed and, after forming a loop between the registration roller pair 10 and the pre-registration conveyance roller pair 44, the speed-up electromagnetic clutch 85 is turned OFF to set the conveying speed to regular speed. When, also after this, feeding and conveyance is performed with a timing such that the inter-sheet distance is the same, it is always possible to perform feeding and conveyance operation with the same conveyance timing after the first sheet material has started to be conveyed from the registration roller pair 10. Further, the positional relationship between the sheet materials being conveyed is fixed independently of the number of sheet materials, so that there is no need to perform a complicated control.

While in Embodiments 1 and 2 the conveyance driving motor M1 is driven at three speeds: regular speed, ½ speed, and ¼ speed, it is also possible to provide a speed other than the conveying speed of the image forming portion, performing conveyance at that speed until the first sheet material reaches the registration roller pair 10 and forms a loop to thereby reduce the first copying (printing) time.

It is to be noted that the dimensions, materials, configurations, and positional relationships of the components described with reference to the above embodiments are to be appropriately changed according to the construction of the apparatus to which the present invention is applied and to various conditions, and the above embodiments should not be construed restrictively.

What is claimed is:

1. An image forming apparatus comprising:

image forming means including an image bearing member for bearing a toner image, and a sheet material supporting member for supporting a sheet material to which the toner image is transferred, and adapted to hold and convey the sheet material between the image bearing member and the sheet material supporting member to thereby transfer the toner image on the image bearing member to the sheet material;

sheet material conveying means for conveying the sheet material toward the image forming means;

registration means for correcting skew of the sheet material conveyed by the sheet material conveying means and conveying the sheet material to the image forming means with a predetermined timing;

an image formation driving source for driving the image forming means;

a conveyance system driving source for driving the sheet material conveying means and the registration means; and control means which makes a speed at which the sheet material is conveyed by said image forming means variable according to the kind of sheet material, which makes a speed at which the sheet material is conveyed by said sheet material conveying means substantially the same as a speed at which the sheet material is conveyed by said image forming means when an image is formed on the sheet material by said image forming means, and which makes a speed at which the sheet material is conveyed by said sheet material conveying means substantially the same as or faster than a speed at which the sheet material is conveyed by the image forming means before image forming means starts to form an image on the sheet material.

2. An image forming apparatus according to claim 1, wherein the control means controls the conveyance system driving source such that the sheet material is conveyed to the image forming means by the registration means at a speed different from the speed at which the sheet material is conveyed to the registration means by the sheet material conveying means.

3. An image forming apparatus according to claim 2, wherein the control means controls the conveyance system driving source and the image formation driving source such that the sheet material is conveyed to the registration means by the sheet material conveying means at a speed higher than the speed at which the sheet material is conveyed by the image forming means.

4. An image forming apparatus according to claim 3, wherein the control means controls the conveyance system driving source such that after the forward end of the sheet material conveyed to the registration means abuts the registration means, the speed at which the sheet material is conveyed by the sheet material conveying means is changed from a first conveying speed to a second conveying speed which is lower than the first conveying speed, and that after the rear end of the sheet material has left the registration means, the speed at which the sheet material is conveyed by the sheet material conveying means is changed from the second conveying speed to the first conveying speed.

5. An image forming apparatus comprising:

image forming means including an image bearing member for bearing a toner image, and a sheet material supporting member for supporting a sheet material to which the toner image is transferred, and adapted to hold and convey the sheet material between the image bearing member and the sheet material supporting member to thereby transfer the toner image on the image bearing member to the sheet material;

sheet material conveying means for conveying the sheet material toward the image forming means;

registration means for correcting skew of the sheet material conveyed by the sheet material conveying means and conveying the sheet material to the image forming means with a predetermined timing;

an image formation driving source for driving the image forming means;

a conveyance system driving source for driving the sheet material conveying means and the registration means;

first drive transmitting means and second drive transmitting means for transmitting a drive from the conveyance system driving source to the sheet material conveying means at different transmission ratios;

transmission ratio switching means for switching drive transmission between the first drive transmitting means and the second drive transmitting means; and control means which makes a speed at which the sheet material is conveyed by the sheet material conveying means variable and which controls the conveyance system driving source and the image formation driving source such that a speed at which the sheet material is conveyed by the registration means is substantially the same as the speed at which the sheet material is conveyed by the image forming means and which controls the transmission ratio switching means such that when the sheet material is conveyed to the registration means, the drive of the conveyance system driving source is transmitted to the sheet material conveying means through the first drive transmitting means, and that when the sheet material is conveyed to the image forming means by the registration means, the drive of the conveyance system driving source is transmitted to the sheet material conveying means through the second drive transmitting means.

6. An image forming apparatus according to claim 5, wherein the transmission ratio switching means is an electromagnetic connecting means for electromagnetically connecting and cutting off the transmission of a rotation drive force, wherein the first drive transmitting means is a rotation drive transmitting member the transmission of which is connected by the electromagnetic connecting means, and wherein the second drive transmitting means is a rotation drive transmitting member which includes a one-way connecting means for exclusively transmitting rotation in one direction and whose reduction ratio is larger than that of the first drive transmitting means.

7. An image forming apparatus according to any one of claims 1 through 6, wherein the control means controls the image formation driving source such that the sheet material is conveyed by the image forming means at two or more conveying speeds.

8. An image forming apparatus according to claim 7, wherein the control means has the function of varying the speed at which the sheet material is conveyed by the image forming means according to the kind of sheet material.

9. An image forming apparatus according to claim 7, wherein the image formation driving source includes different image formation driving sources respectively driving the image bearing member and the sheet material supporting member.

10. An image forming apparatus according to claim 7, wherein the image forming means includes:

a plurality of image bearing members, and a sheet material sequential conveyance means for sequentially conveying the sheet material to the plurality of transfer nip portions as the sheet material supporting member, wherein toner images respectively borne by the plurality of image bearing members are sequentially transferred to the sheet material conveyed by the sheet material sequential conveyance means.

11. An image forming apparatus according to claim 10, wherein the image formation driving source includes different image formation driving sources for respectively driving the plurality of image bearing members and the sheet material sequential conveyance means.

12. An image forming apparatus according to claim 7, further comprising a fixing means which holds and conveys a sheet material to which an unfixed toner image has been transferred to thereby fix the toner image to the sheet material, wherein the fixing means is driven by the image formation driving source, and conveys the sheet material at a speed which is substantially the same as the speed at which the sheet material is conveyed by the image forming means.

13. An image forming apparatus comprising:

image forming means for conveying a sheet material and forming an image on a sheet material;

conveying means for conveying the sheet material toward the image forming means;

an image formation driving source for driving the image forming means;

a conveyance system driving source for driving the conveying means; and control means which makes a speed at which the sheet material is conveyed by the image forming means variable according to a kind of sheet material, which makes a speed at which the sheet material is conveyed by the conveying means substantially the same as a speed at which the sheet material is conveyed by the image forming means when an image is formed on the sheet material by said image forming means, and which makes a speed at which the sheet material is conveyed by said sheet material conveying means substantially the same as or faster than a speed at which the sheet material is conveyed by the image forming means before image forming means starts to form an image on the sheet material.

14. An image forming apparatus according to claim 13, wherein the control means controls the conveyance system driving source such that the sheet material is conveyed at a speed higher than the speed at which the sheet material is conveyed by the image forming means before the sheet material is conveyed by the image forming means.

15. An image forming apparatus according to claim 13, wherein the control means has the function of varying the speed at which the sheet material is conveyed by the image forming means according to the kind of the sheet material.

16. An image forming apparatus according to claim 13, wherein the image forming means includes:

a plurality of image bearing members for bearing a different color toner image, and a conveying belt for conveying the sheet material, wherein the sheet material is conveyed between the image bearing members and the conveying belt by the conveying belt.

17. An image forming apparatus according to claim 16, wherein the image forming means further includes a fixing means for fixing an unfixed image to the sheet material, and the image formation driving source for driving the image bearing members, the conveying belt, and the fixing means.

* * * * *

UNITED STATES PATENT AND TRADEMARK OFFICE

CERTIFICATE OF CORRECTION

PATENT NO. : 6,608,991 B2
DATED : August 19, 2003
INVENTOR(S) : Hideaki Takada

It is certified that error appears in the above-identified patent and that said Letters Patent is hereby corrected as shown below:

Column 5,
Line 40, “id” should read -- 1d --.

Column 9,
Line 24, “speed.” should read -- speeds. --.

Signed and Sealed this

Third Day of February, 2004

JON W. DUDAS
*Acting Director of the United States Patent and Trademark Office*